United States Patent [19]

Takano et al.

[11] Patent Number: 4,517,946

[45] Date of Patent: May 21, 1985

[54] FUEL INJECTION PUMP

[76] Inventors: Yoshiya Takano, 2-5, Miyamae Terasu Apt., 978, Ichige, Katsuta-shi, Ibaraki-ken; Yoshikazu Hoshi, 2650-62, Muramatsu, Toukai-mura, Naka-gun, Ibaraki-ken, both of Japan

[21] Appl. No.: 467,302

[22] Filed: Feb. 17, 1983

[30] Foreign Application Priority Data

Feb. 17, 1982 [JP] Japan ..... 57-22632
Mar. 29, 1982 [JP] Japan ..... 57-48906

[51] Int. Cl.[3] ..... F02M 39/00

[52] U.S. Cl. ..... 123/450; 123/458; 417/253; 417/462

[58] Field of Search ..... 123/450, 357, 458, 479; 417/253, 252, 462; 239/88-95

[56] References Cited

U.S. PATENT DOCUMENTS 3,506,381 4/1970 Kemp ..... 123/450
3,834,361 9/1974 Keely ..... 123/479
3,851,635 12/1974 Murtin et al. ..... 123/458
4,326,672 4/1982 Goloff ..... 239/91
4,428,346 1/1984 Hoshi ..... 123/458

FOREIGN PATENT DOCUMENTS 1919707 11/1970 Fed. Rep. of Germany ..... 123/450
2235276 1/1975 France ..... 123/450
391383 9/1965 Switzerland ..... 123/450

*Primary Examiner*—Carl S. Miller
*Attorney, Agent, or Firm*—Antonelli, Terry & Wands

[57] ABSTRACT

A fuel injection pump comprises a rotor located in a housing, a free piston movably mounted in an axial bore of the rotor, two pump chambers which is formed by dividing said bore by the free piston, and two solenoid valves for supplying fuel to the two pump chambers, one of the chambers receiving therein the fuel to be injected and the other for effecting control of the injection timing. This injection pump is characterized in that two preparatory chambers are provided downstream of the solenoid valves to keep fuel measured by the solenoid valves during the compression operation of said pump chambers and transfer the fuel to said pump chamber after completion of the compression whereby precise measurement of the fuel can be effected.

8 Claims, 16 Drawing Figures

FUEL INJECTION PUMP

BACKGROUND OF THE INVENTION

This invention relates to fuel injection pumps for internal combustion engines, and more particularly to fuel injection pumps for internal combustion engines capable of precisely controlling the amount of fuel injected and the injection timing.

Fuel injection pumps are used for feeding fuel at high pressure into the interior of internal combustion engines such as diesel engines. In recent years, a demand has been created for relying on electronic control for effecting control of the amount of the fuel injected and the injection timing of a fuel injection pump. A device of this type is shown in U.S. Pat. No. 4,185,779 issued Jan. 29, 1980, for example.

In the fuel injection pump incorporating therein the control device of this type, control of the amount of the fuel injected and the injection timing are effected by feedback control utilizing the servomechanism. A device of this type is complex in construction and high in cost.

An application for a patent (Ser. No. 304,359) was filed by the present application in the United States of America on Sept. 22, 1981 for a fuel injection pump capable of readily controlling both the amount of the fuel injected and the injection timing. The fuel injection pump comprises a rotor located in a cylindrical housing, a free piston movably mounted in an axial bore in the rotor, two pressure chambers defined by an inner wall surface of the axial bore in the rotor and the free piston, and two solenoid valves for supplying fuel to the two pressure chambers. One of the two pressure chambers receives therein the fuel to be injected and the other pressure chamber receives therein the fuel for effecting control of the injection timing. The two pressure chambers are separated from each other by the movable free piston.

The fuel injection pump described hereinabove is capable of readily controlling the amount of the fuel injected and the injection timing by virture of the aforesaid construction.

However, it is difficult to precisely measure an amount of fuel injected and make the timing control range sufficiently wide under the entire engine operation from low speed to high speed. The fuel injection pump distributes measured fuel to each cylinder in one rotation of the rotor, therefore, it is necessary to measure fuel, feed the pump chamber with the measured fuel, then effect compression and delivery of the fuel during the angular advance of the rotor corresponding to one of engine cylinders which is 90° in case of a four cylinder engine. In this case, in order to carry out sure measurement of fuel injected, it is necessary to have a long operation time of the solenoid valve within the period of the measurement and feed of the fuel.

On the other hand, in order to increase the control freedom of fuel injection timing, it is necessary to start the operation of the pump chamber earlier. The early start is effected by making the slope for compression of a cam ring pressing a plunger longer. By this reason, in the fuel injection pump, the angular advance per one cylinder is divided into exact halves, one of which is for the measurement and feed and the other, for the compression and delivery. In such control, the measurement and feed are carried out at the same time, so that the rotational speed of the engine influences them greatly.

In this pump, fuel from the solenoid value is fed to the pump chamber through an effective opening formed by communication of a rotary port and a stationary port. Therefore, at a low speed of the engine, the fuel is fed when the effective opening is opened insufficiently, and at a high speed, the effective opening disappears during the measurement of the fuel so that part of the fuel cannot be fed to the pump chamber. Thus, sufficiently precise or sure measurement of the fuel injected is difficult. Further, the injection timing control is effected by feeding another pump chamber with fuel measured by the solenoid valve for the injection timing control, and adjusting the time the plunger starts to contact the cam ring. In this case, also, the fuel introduction into the pump chamber for the timing control is effected through an effective opening formed by communication of the rotary port and the stationary port. Therefore, though the injection timing control range is widened by the compression slope of the cam ring, the long compression slope requires a larger angular advance, accordingly, which influences on the measurement of fuel to be injected.

Thus, the abovementioned fuel injection pump is required to be capable of more precise or sure control of an amount of fuel to be injected and injection timing.

SUMMARY OF THE INVENTION

An object of the invention is to provide a fuel injection pump for internal combustion engines which is able to enhance preciseness in the measurement of fuel to be injected and make the injection timing control range wider.

Another object of the invention is to provide a fuel injection pump which is able to enhance preciseness in the measurement of fuel injected and widen the injection timing control range, without making the construction large and complicated.

To accomplish the objects, the invention provides, in a fuel injection pump for an internal combustion engine comprising a rotor located in a housing and driven by the engine, a free piston movably mounted in an axial bore of the rotor, two pump chambers defined the free piston, and two solenoid valves for measuring fuel and supplying the fuel to the two pump chambers, one of which receives the measured fuel to be injected and the other receives the measured fuel for control of the ignition timing, two preparatory chambers provided downstream of said solenoid valves for keeping the measured fuel during the compression of said pump chambers and delivering the fuel to said compression chambers after the completion of the compression operation.

The two preparatory chambers can be arranged in the housing such that the axes of the preparatory chambers are disposed in a plane perpendicular to the axis of the rotor whereby a small scaled fuel injection pump can be made.

DESCRIPTION OF THE PREFERRED EMBODIMENTS

An embodiment of the fuel injection pump according to the present invention will be described herein in detail, referring to FIGS. 1 to 12.

Figure 1:
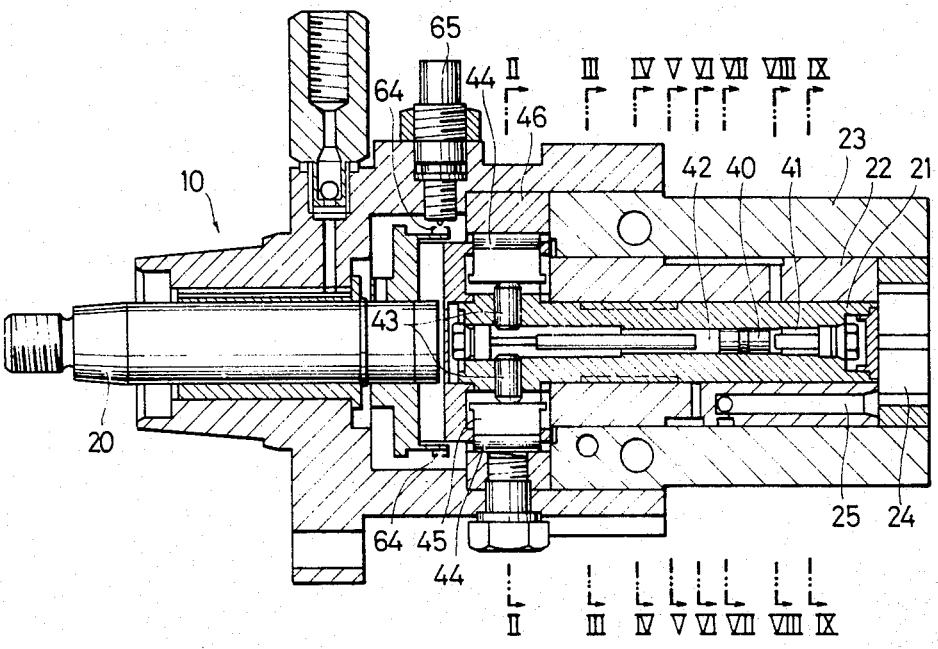
FIG. 1 is a vertical sectional view of an embodiment of the fuel injection pump for an internal combustion engine according to the invention.
Figure 2:
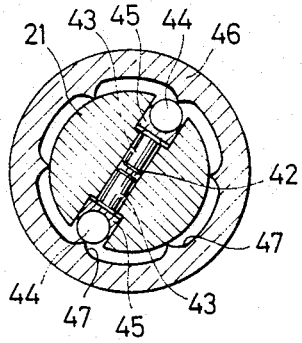
FIG. 2 is a sectional view taken along the line II—II in FIG. 1.
Figure 3:
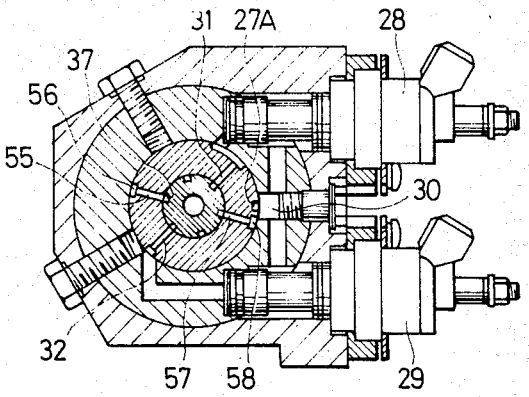
FIG. 3 is a sectional view taken along the line III—III in FIG. 1.
Figure 7:
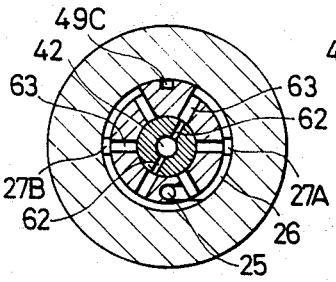
FIG. 7 is a sectional view taken along the line VII—VII in FIG. 1.
Figure 8:
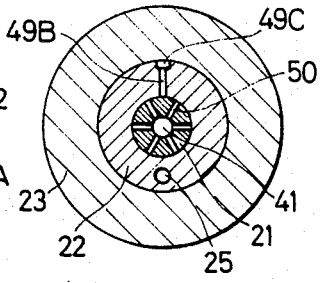
FIG. 8 is a sectional view taken along the line VIII—VIII in FIG. 1.

In FIG. 1 showing a vertical sectional view of a fuel injection pump for a six cylinder engine, the fuel injection pump 10 has a shaft 20, driven by the engine and connected to a rotor 21. The rotor 21 is rotatably inserted in a sleeve 22 which is inserted in and secured to a hydraulic head 23. The sleeve 22 and head 23 constitute a cylindrical housing. At one end portion of the rotor 21, a feed pump 24 is provided for supplying fuel under a pressure for example 6 kg/cm$^2$ into the pump 10. The fuel passage is formed in the pump 10 as follows. An induction passage 25 for introducing fuel from the feed pump 24 after regulation by a conventional regulator (not shown) into the pump 10 is bored in the sleeve 22. The passage 25 communicates with a peripheral groove 26 formed on the periphery of the sleeve 22 as shown in FIG. 7. The groove 26 communicates with a pair of axial feed passages 27A and 27B formed on the periphery of the sleeve 22 so as to extend axially. One of the feed passages 27A communicates with a stationary passage 30 (FIG. 3) formed in the hydraulic head 23. The passage 30 communicates with both a first solenoid valve 28 for measuring an amount of fuel to be injected and a second solenoid valve 29 relating to injection timing control, each connected to the hydraulic head 23. The feed passages 27A, 27B are able to communicate with preparatory chambers which are described later.

The stationary passage 30 on which the first and second solenoid valves 28, 29 are provided communicates with a pair of first and second stationary passages 31 and 32 which are formed radially in the sleeve 22 and spaced angularly 180° from each other. The passages 31, 32 are for delivering fuel measured by the solenoid valves 28, 29.

Figure 4A:
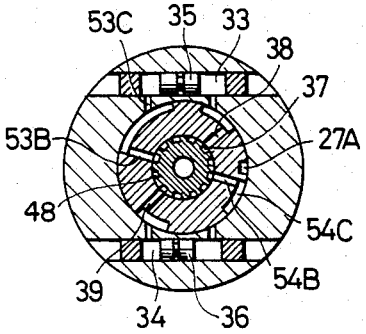
FIG. 4A is a sectional view taken along the line IV—IV in FIG. 1.
Figure 10:
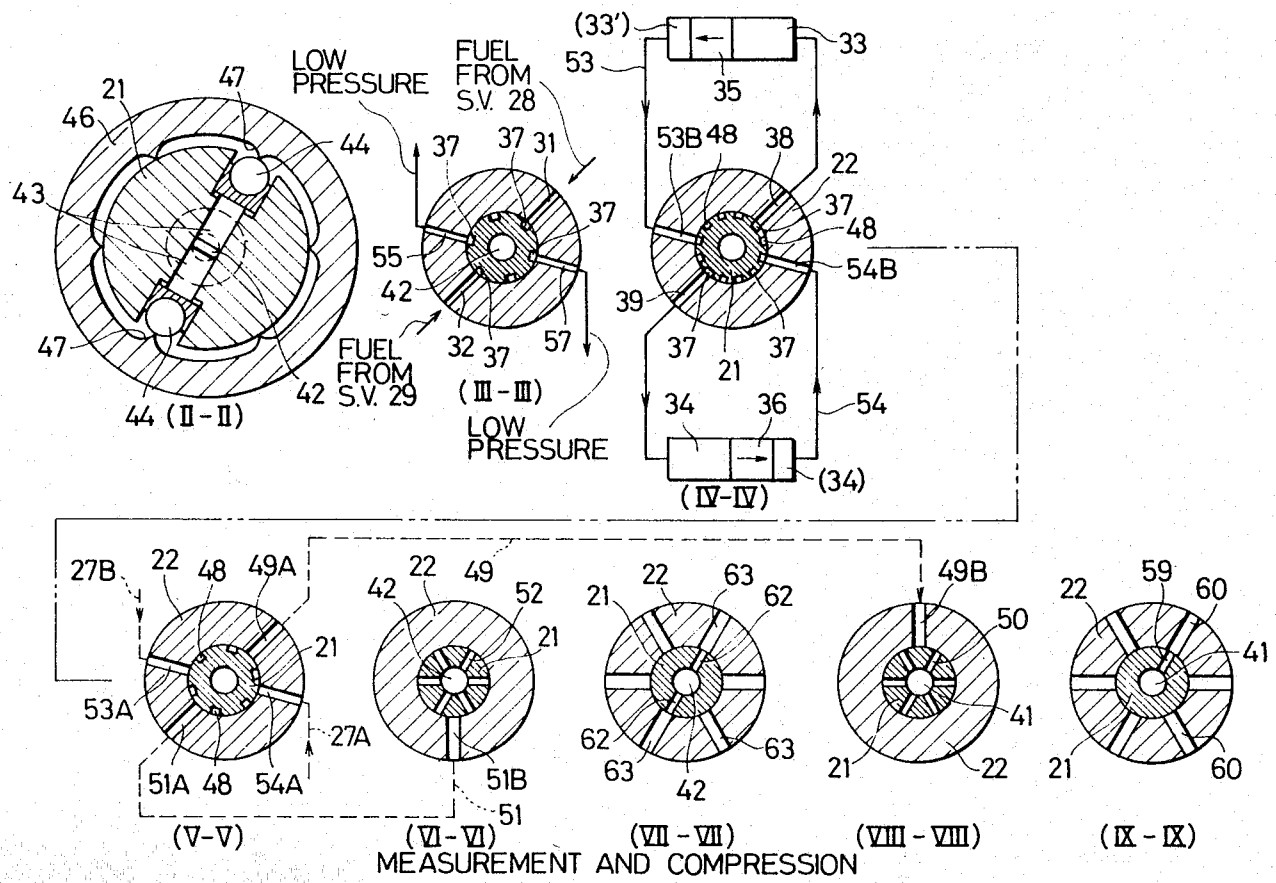
FIG. 10 is for explanation of fuel measurement and compression conditions of the fuel injection pump in FIG. 1, wherein a relative angular position of the rotor and sleeve is shown.

In the hydraulic head 23, a pair of first and second preparatory chambers 33 and 34 are formed so to be arranged in parallel to each other in a plane taken perpendicularly to the axis of the rotor 21. The first and second preparatory chambers 33, 34 constitute cylinders and have therein free pistons 35, 36 respectively, thereby dividing each of them into two chambers (33, 33', 34, 34'). One chamber of each preparatory chamber 33, 34 keeps, for a short time, fuel measured by the first and second solenoid valves 28, 29. The fuel is fed to the first and second preparatory chambers 33, 34 through measurement fuel feed switching grooves 37 formed axially on the periphery of the rotor 21. Namely, the switching grooves 37 are ones formed equiangularly spaced on the periphery of the rotor 21 in numbers corresponding to the numbers of the cylinders. And the switching grooves 37 are constructed such that two of them spaced 180° from each other communicate with the first and second stationary passages 31, 32 at the same time. Simultaneously, passages 38, 39 which are brought into communication with the first and second preparatory chambers 33, 34 through the switching groove 37 are formed in the sleeve 22 (FIG. 4 and FIG. 10). Therefore, when the switching grooves 37 reach a predetermined position by rotation of the rotor 21, the first and second solenoid valves 28, 29 are given signals signals to open the valves, whereby the amount of the fuel measured by valve-opening time enters the first and second preparatory chambers 33, 34.

A pump chamber is formed in the central portion of the rotor 21 and divided into first and second pump chambers 41, 42 by a free piston 40 inserted in the pump chamber to reciprocate therein. In order to cause pumping operation, a pair of plungers 43 (FIG. 2) are inserted in the rotor 21 with the plungers being opposed to one another and partially disposed in the second pump chamber 42. Each of the plungers 43 is provided with a shoe 45 and a roller 44 at its top portion. Around the periphery of the rotor 21, a cam ring 46 formed to surround the rollers is fixed to the end portion of the hydraulic head 23. The cam ring 46 has the same numbers of projections 47 on the inner face as the numbers of the cylinders. The roller 44 can slide on the inner face of the cam ring 46. Therefore, as the rotor 21 rotates, the roller 44 contacts with the projections 47 whereby the plungers 43 are pressed to raise the pressure in the second pump chamber 42. Therefore, the measured fuel in the first pump chamber 41 is raised in pressure by the free piston 40 moved by the fuel raised in pressure in the second pump chamber 42. The cam ring 46 is set so that fuel compression is conducted in the first and second pump chambers 41, 42 within the time the measured fuel is introduced into the preparatory chambers 33, 34.

Figure 12:
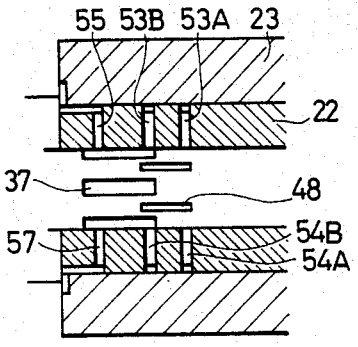
FIG. 12 is a vertical sectional view showing relative size of grooves 37 and 48.

Further, fuel transfer switching grooves 48 are formed on the periphery of the rotor 21 for supplying the fuel contained in the first and second preparatory chambers 33, 34 after being measured to the first and second pump chambers 41, 42 after the completion of the compression of fuel in the pump chambers 41, 42. The transfer switching grooves 48 are axial passages spaced equiangularly from each other and the number of the grooves 48 is the same as the numbers of the cylinders. The angular position of the grooves 48 is displaced by half the advance angle corresponding to one of the cylinders (30° in this case). The grooves 48 partially axially overlap the switching groove 37 (FIG. 4 and FIG. 12). Therefore, the transfer switching grooves 48 are brought into communication with the preparatory chamber 33, 34 through the radial passages 38, 39 after the fuel introduction from the solenoids 28, 29 to the preparatory chambers 33, 34 is completed and when the axial passages 38, 39 are interrupted to communicate with the switching grooves 37. Further, the grooves 48 communicate with the first and second pump chambers 41, 42 when communicating with the preparatory chambers 33,34. Namely, a first fuel transfer passage 49 which is brought into communication with the first preparatory chamber 33 is formed on the periphery of the sleeve 22. The first fuel transfer passage 49 comprises a radial passage 49A (FIG. 5) capable of communication with the transfer switching grooves 48, a radial passage 49B (FIG. 8) formed at a position corresponding to the first pump chamber 41, and an axial passage 49C formed on the periphery of the sleeve 22 to extend axially thereby connecting both the radial passages 49A and 49B. The rotor 21 is provided with first inlet ports 50 capable of communication with the first pump chamber 41. The ports 50 extend radially and the number of the parts is the same as the number of the cylinders. One of the first inlet ports 50 communicates with the first fuel transfer passage 49 simultaneously with the time the transfer switching groove 48 is brought into communication with the first preparatory chamber 33. The sleeve 22 has a second fuel transfer passage 51 formed therein which is brought into communication with the second preparatory chamber 34 (FIG. 5). The second fuel transfer passage 51 comprises a radial passage 51 capable of communication with the switching grooves 48, a radial passage 51B formed at a position corresponding to the second pump chamber 42 (FIG. 6) and an axial passage 51C axially extending on the periphery of the sleeve and connecting the radial passages 51A and 51B. The rotor, further, is provided with second inlet ports 52 communicating with the second pump chamber 42. At the same time that the first fuel transfer passage 49 is brought into communication with the first pump chamber 41, the second fuel transfer passage 51 and the second pump chamber 42 are connected.

The measured fuel in the first and second preparatory chambers 33, 34 is transferred to the first and second pump chambers 41, 42 by utilizing the delivery pressure of the feed pump 24. Namely, the fuel transfer is conducted by connecting each of the passages 27B and 27A, each of the other chambers 33', 34' which are separated by the free pistons 35, 36 from the chambers 33, 34. Concretely, one of the induction passages 27B is connected to the first preparatory chamber 33' through a first pressure passage 53 formed in the sleeve 22. This connection is completed by connecting a radial passage 53A (FIG. 8) to a radial passage 53B (FIG. 7) through the transfer switching groove 48, and connecting the radial passage 53B to the preparatory chamber 33' through a radial passage 53C (FIGS. 3 and 4) formed in the periphery of the sleeve 22. The other inlet passage 27A is connected to the second proparatory chamber 34' through a second pressure passage 54 which is branched on the way to the solenoids 28, 29. This connection is complete by connecting a radial passage 54A (FIG. 5) to an axial passage 54B (FIG. 4) through the transfer switching groove 48, and by leading the connected passage to the second preparatory chamber 34' through an axial passage 54.

Figure 4B:
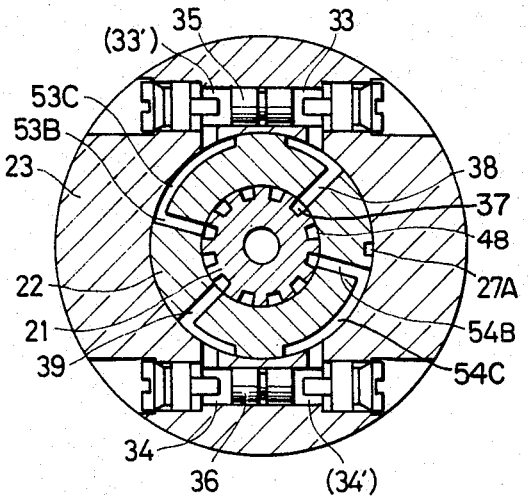
FIG. 4B is an enlarged view of FIG. 4A.
Figure 5:
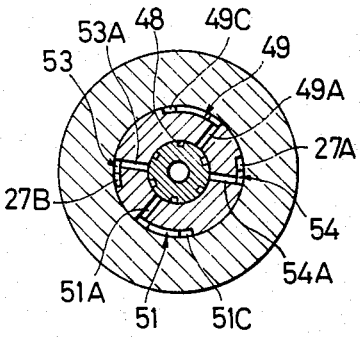
FIG. 5 is a sectional view taken along the line V—V in FIG. 1.
Figure 6:
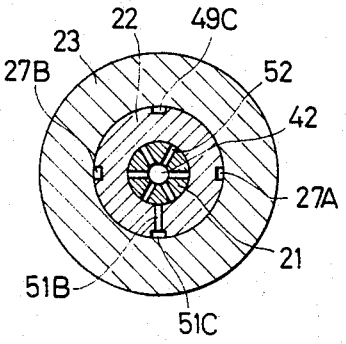
FIG. 6 is a sectional view taken along the line VI—VI in FIG. 1.

Further, the radial passages 53B, 54B of the first and second pressure passages 53, 54 are capable of communication with the switching groove 37 as noted from FIG. 4B, and when fuel is fed the preparatory chamber 33, 34 upon opening of the valves, the radial passages 53B, 54B are for opening the pressure chambers of the preparatory chambers 33, 34 to low pressure portions so that the free pistons 35, 36 can be shifted. This is conducted by a first relief passage comprising a radial passage 55 connected to the radial passage 53B by the switching grooves 37, a radial passage 57 connected to the radial passage 54B by the switching groove 37, and a second relief passage comprising a radial passage 57 connected to the radial passage 54B by the switching grooves 37, and an axial channel opened to the end of the rotor 21.

Figure 9:
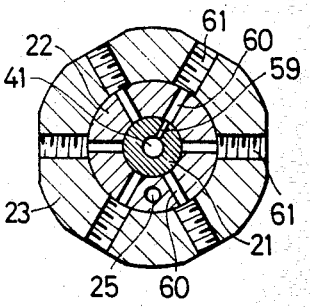
FIG. 9 is a sectional view taken along the line IX—IX in FIG. 1.

The rotor 21 is provided with a distribution port 59 opened to the first pump chamber 41, and the port 59 is capable of connection to delivery ports 60 formed radially in the sleeve 22 (FIG. 9). The delivery ports 60 are capable of communication with engine nozzles (not shown) through passages 61 formed in the head 23.

A pair of relief ports 62 are opened to the second pump chamber 42 (FIG. 7), and capable of communication with the peripheral passage 26 through a stationary radial passages 63. The relief ports 62 are usually closed by the free piston 40, and the position of the ports 62 is set such that the ports 62 communicate with the second pump chamber 42 when the free piston 40 shown FIG. 1 is shifted at the right end, that is, when the fuel in the first pump chamber 41 is delivered.

For determination of the timing of opening of the solenoids 28, 29, a detector 65 is provided which detects a position of timing-detecting terminals 64 mounted equiangularly on the shaft 20, which terminals are the same numbers as the cylinder numbers. The timing determined by the detector 65 is synchronized with the timing that the switching groove 37 brings the first and second stationary passages 31, 32 into communication with the passages 38, 39 leading to ones of the preparatory chambers 33, 34, and simultaneously the other ones of the preparatory chambers 33', 34' communicate with the first and second relief passages (55 to 58).

Thus constructed, the fuel injection pump carries out a fuel compression process of measuring fuel supplied from the feed pump 24 and simultaneously compressing fuel fed the pump chamber in advance, and a process of transferring the fuel in the first and second preparatory chambers 33, 34 to the first and second pump chambers 41, 42.

Figure 11:
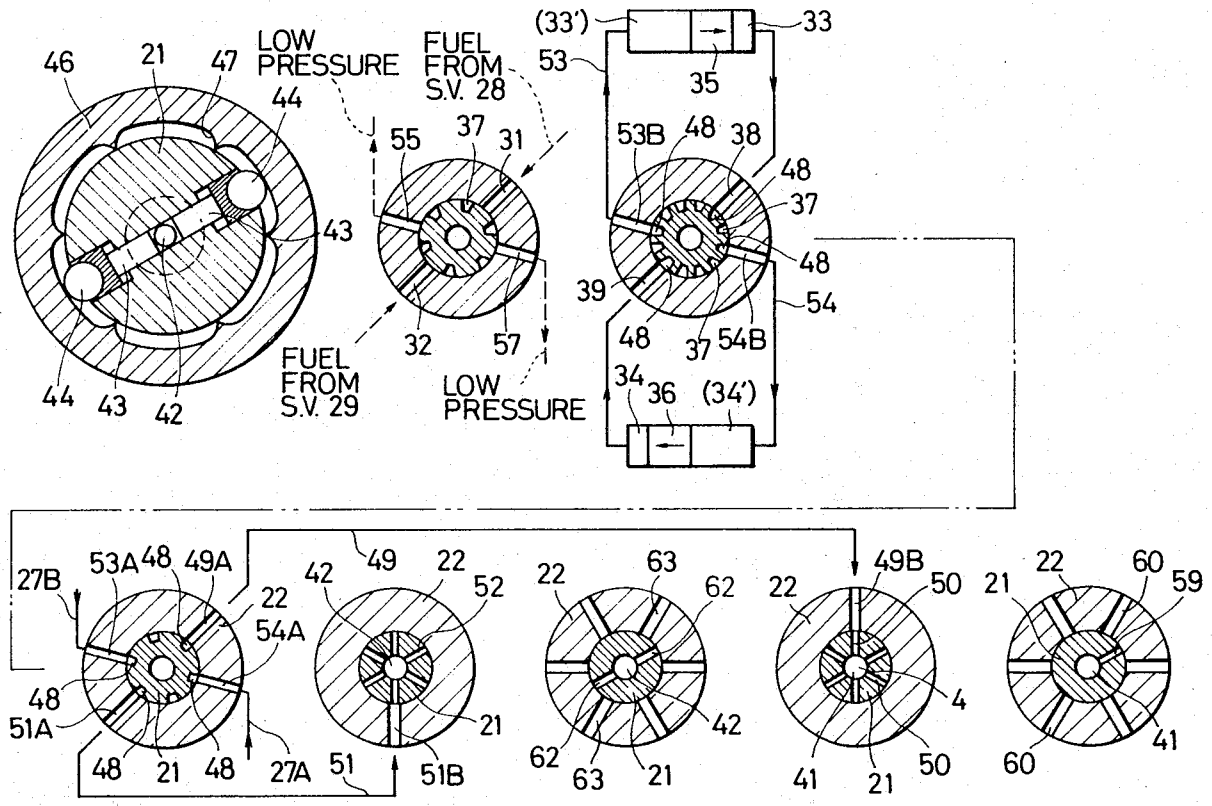
FIG. 11 is for explanation of fuel transfer and corresponds to FIG. 10 except for relative angular position of the rotor and sleeve.

FIG. 10 is sectional views of various parts of the injection pumps for explanation of the measuring and compression processes, and FIG. 11 is for explanation of the transferring process using sectional views of various portions of the injection pump.

The measuring and compressing processes are conducted as follows: Fuel from the feed pump 24 is transferred to the first and second solenoid valves 28, 29 through various fuel passages (25 26 27A 30). The solenoid valves 28, 29 are given signals from the detector 65 to open when the detector 65 detects the timing detecting terminal 64. The first solenoid valve 28 for the fuel measurement opens for time length corresponding to control pulse width and measures an amount of fuel. The measured fuel enters the first preparatory chamber 33 through the first stationary passage 31, the switching groove 37 and the radial passage 38, whereby the free piston 35 is moved leftwise as an arrow in FIG. 10. Fuel pushed off is discharged to a lower pressure portion through the switching groove 37, the first fuel relief passages 55, 56.

The second solenoid valve 29 for the timing control opens correspondingly to the pulse width of the signals from the detector 65 to measure fuel. The measured fuel enters the second preparatory chamber 34 through the second stationary passages 32, the switching groove 37 and the radial passage 39. This causes the movement of the free piston 36 in the direction of the arrow in FIG. 10 which thereby pushes fuel off to be discharged into a lower pressure portion through the switching groove 37 and the second fuel relief passages 57, 58. Thus, the measurement is finished, and during this period the another transfer switching groove 48 is not connected to the other ports. Further, in the period of the above-mentioned measurement, the first and second pump chambers 41, 42 are carrying out compression of fuel independent of this measurement. Next, however, the fuel transfer from the preparatory chambers 33, 34 to the pump chambers 41, 42 will be explained before explanation of the compression.

FIG. 11 shows the condition of the fuel injection pump in which the rotor 21 is rotated by 30° after completion of the measurement.

As noted from FIG. 11, the transfer switching groove 48 brings the preparatory chambers 33, 34 into communication with the first and second fuel transfer passages 49, 51. At the same time, another pair of the transfer switching grooves 48 connect the passages 27A, 27B at the feed pump side and the second and first pressure passages 54, 53, whereby the pressure applied by the feed pump is applied in the first preparatory chamber 33 through the passage 27B, 53A, the switching groove 48 and passages 53B, 53C, so that the free piston 35 is pressed right. On the other hand, the second preparatory chamber 34, also, has feed pump pressure applied through the passages 27A, 54A, 48, 54B, 54C in the same manner whereby the free piston 36 is pressed left. By this pressing operation, all amount of the measured fuel in the preparatory chambers 33, 34 is supplied to the first and second pump chambers 41, 42 through the first and second fuel transfer passages 49, 51.

Behavior of fuel in the pump chambers is as follows:

Fuel is supplied to the first pump chamber 41 for injection into the engine cylinders is supplied. The fuel introduction into the chamber 41 makes the free piston 40 move to the left as shown in FIG. 1, whereby the plungers 43 are pressed outside so that the rollers 44 approach the cam ring 46. Further, the introduction of fuel from the second preparatory chamber 34 into the second pump chamber 42 causes the top of the rollers 44 the project further outwardly, and the compression starts at the position of the plungers 43. Therefore, control of an amount of fuel supplied into the second pump chamber 42 results in control of the injection timing, and the control of the fuel amount is determined according to the control pulse width of the second solenoid valve 29.

The compression operation as shown in FIG. 10 is conducted as follows:

Upon rotation of the rotor 21, the rollers 44 contact the projections of the cam ring 46 so that the plungers 43 are pushed inside, whereby the second pump chamber 42 becomes higher in pressure, and at the same time, the free piston is moved left so that the interior of the first pump chamber 41 is higher in pressure. At this time, the distribution port 59 and the delivery port 60 are in communication, and high pressure fuel is injected into an engine room through delivery valves and nozzles (not shown). By this fuel delivery, the free piston moves right, and the second pump chamber 42 communicates with the stationary passage 63 whereby high pressure in the second pump 42 is relieved to a lower pressure region. Therefore, the pressure in the first pump chamber 41 decreases and the fuel injection finishes.

After that, the measurement, compression process and the fuel transfer operation are repeated, whereby the pumping is effected.

According to the present embodiment, the measurement and compression are conducted at the same time by the first and second solenoid valves 28, 29, and the fuel transfer is conducted independent of the measurement and compression of fuel. Therefore, the fuel measurement is not influenced by the rotationary speed of the rotor 1, and the problems of control width and effective opening area of ports previously mentioned are obviated.

In FIG. 12, a relative scale of the width of measurement fuel switching groove 37 and that of the transfer switching groove 48 are shown. By making the width of the former (37) wider than the latter (48), measurement and compression period can be made longer than that of the fuel transfer period because the communication condition time between the ports 55, 53B and the switching groove 37 is longer than that between the ports 53A, 53B and the switching groove 48. Therefore, the operation time of the solenoid valves 28, 29 can be longer so that control range can be widened, and control range of the time the injection timing starts is wider by making a cam having a longer slope. This is effective for reduction of the surface pressure of the cam.

Figure 13:
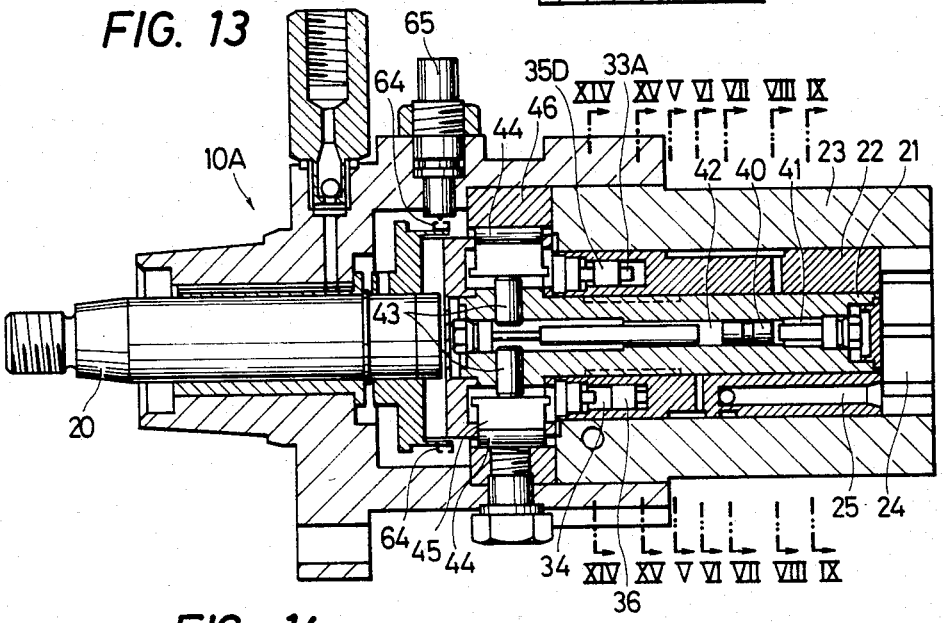
FIG. 13 is a vertical sectional view of another embodiment of a fuel injection pump according to the invention.
Figure 14:
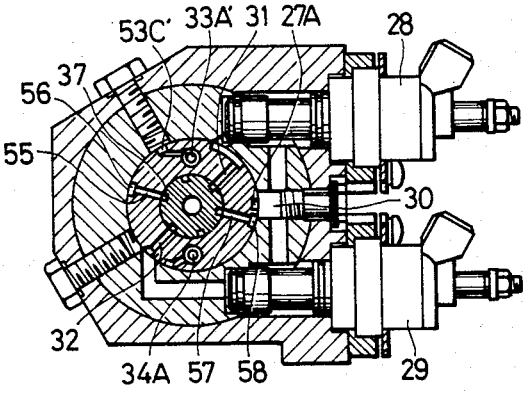
FIG. 14 is a sectional view taken along the line XIV—XIV.
Figure 15:
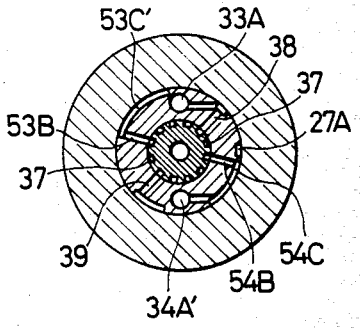
FIG. 15 is a sectional view taken along the line XV—XV.

Another embodiment of the fuel injection pump 10A is shown in FIGS. 13 to 15. This embodiment differs from the previous embodiment only in that preparatory chambers 33A and free pistons 35B are arranged axially. Therefore, as seen from FIGS. 14 and 15 the passage 53C' is made axially longer than the passage 53C which is disposed in a plane of the section IV—IV. The operation of the pump 10A is the same as the pump 10.

The pump 10 is more advantageous than the pump 10A in that the axial size can be made smaller than pump 10A by (the preparatory chamber 33A minus (−) the diameter of the preparatory chamber 33), and in that the pump 10 is made smaller in the size and made easily.

What is claimed is:

1. A fuel injection pump for an internal combustion engine comprising: a rotor disposed in a housing and rotating according to running of the engine;

a pressure chamber formed in said rotor;

a first free piston slidably mounted in said pressure chamber;

first and second pump chambers defined by an inner surface of said pressure chamber and said first free piston, said first pump chamber provided with a port which is capable of communication with an interior of the engine; and said second pump chamber provided with a discharge port;

means for compressing fuel in said second pump chamber in accordance with rotation of said rotor whereby the fuel in said first chamber is compressed and delivered to said engine through said port;

first and second fuel passage means leading to said first and second pump chambers, respectively;

first and second solenoid valves, provided on said first and second passage means, for measuring amount of fuel;

first and second preparatory chambers provided downstream of said first and second solenoid valves, respectively, said preparatory chambers being capable of communication with said first and second solenoid valves and said first and second pump chambers by said first and second fuel passage means so that the measured fuel is kept in said first and second preparatory chambers during the compression of said pump chambers and transferred to said first and second pump chambers, respectively, and wherein said first and second preparatory chambers comprises cylinders and second free pistons movably mounted in said cylinders, respectively, and are arranged in said housing such that the axes of said first and second preparatory chambers are disposed in a plane perpendicular to the axis of said rotor.

2. The fuel injection pump as defined in claim 1, further including a feed pump for supplying a fuel to said first and second passage means, wherein said rotor is provided with switching means, and each of said first and second preparatory chambers is divided into two chambers by said second free pistons, each of said two divided chambers being brought into communication with said feed pump alternatively by said switching means so that the pressure of said feed pump applied on one of said chambers delivers the fuel in the other chamber to said pump chamber.

3. The fuel injection pump as defined in claim 2, wherein said switching means are grooves formed on the periphery of said rotor.

4. A fuel injection pump for an internal combustion engine comprising:

a rotor adapted to rotate in a housing according to running of the engine;

a cylindrical bore formed in said rotor so as to extend axially;

a first free piston adapted to reciprocate in said bore and dividing said bore into a first pump chamber and a second pump chamber, said first pump chamber provided with an inlet port capable of communication with an interior of the engine, and said second pump chamber provided with a discharge port;

means for compressing fuel in said second pump chamber in accordance with rotation of said rotor to move said free piston whereby fuel in said first pump chamber is compressed and delivered to said engine through said inlet port;

first and second fuel passage means leading to said first and second pump chambers from a fuel source, respectively;

first and second solenoid valves, provided on said first and second passage means, for measuring fuel amount;

first and second preparatory chambers provided on said first and second fuel passage means downstream of said first and second solenoid valves, respectively; and first and second switching means provided on said first and second fuel passage means between said first and second preparatory chambers and said first and second pump chambers, respectively, for interrupting communication between said first and second preparatory chambers and said first and second pump chambers while fuel is supplied into said first and second preparatory chambers through said first and second solenoid valves and said first and second pump chambers are in compression, whereby measurement of fuel and compression of fuel in said first and second pump chambers are effected at the same time.

5. The fuel injection pump as defined in claim 4, wherein said switching means comprises switching grooves formed in said rotor and fuel passages formed in said housing, said switching grooves and said fuel passages of said housing being parts of said fuel passage means, and the switching operation being carried out by relative movement between said switching grooves and said fuel passages of said housing according to rotation of said rotor.

6. The fuel injection pump as defined in claim 5, wherein each of said first and second preparatory chambers comprises a cylinder formed in said housing and a second free piston adapted to reciprocate in said cylinder, each of said cylinders being divided into two parts by said second piston.

7. The fuel injection pump as defined in claim 6, wherein said first solenoid valve is for measurement of amount of fuel for the engine and fluidly connected to said first pump chamber through said first fuel passage means, said first preparatory chamber and said first switching means; said second solenoid valve is for timing control and fluidly connected to said second pump chamber through said second fuel passage means, said second preparatory chamber and said second switching means.

8. The fuel injection pump as defined in claim 7, wherein one part of said first preparatory chamber is fluidly connected to said first fuel passage means, the other part is provided with third fuel passage means constructed such that said other part of said first preparatory chamber communicates with said fuel source when fuel is transferred from said first part of said first preparatory chamber to said first pump chamber and fourth fuel passage means for discharging fuel therein when said first part of said first preparatory chamber is supplied with fuel from said first solenoid valve; one part of said second preparatory chamber is fluidly connected to said second fuel passage means, the other part is provided with fifth fuel passage means constructed such that said other part of said second preparatory chamber communicates with said fuel source when fuel is transferred from said first part of said second preparatory chamber to said second pump chamber and sixth fuel passage means for discharging fuel in said other part of said second preparatory chamber when said first part of said second preparatory chamber is supplied with fuel from said second solenoid valve.

* * * * *